US012083372B2

(12) United States Patent
Lee

(10) Patent No.: US 12,083,372 B2
(45) Date of Patent: Sep. 10, 2024

(54) FITNESS MECHANISM WITH ADJUSTABLE RESISTANCE

(71) Applicant: CHI HUA FITNESS CO., LTD., Hsinchu County (TW)

(72) Inventor: Chia Jung Lee, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 127 days.

(21) Appl. No.: 18/060,019

(22) Filed: Nov. 30, 2022

(65) Prior Publication Data

US 2024/0173588 A1 May 30, 2024

(51) Int. Cl.

| | |
|---|---|
| ***A63B 21/005*** | (2006.01) |
| ***A63B 21/00*** | (2006.01) |
| ***A63B 21/22*** | (2006.01) |
| ***A63B 23/035*** | (2006.01) |
| ***A63B 23/12*** | (2006.01) |
| ***A63B 24/00*** | (2006.01) |

(52) U.S. Cl.

CPC ..... *A63B 21/0052* (2013.01); *A63B 21/153* (2013.01); *A63B 21/225* (2013.01); *A63B 23/03533* (2013.01); *A63B 23/12* (2013.01); *A63B 24/0087* (2013.01)

(58) Field of Classification Search

CPC . A63B 21/0052; A63B 21/153; A63B 21/225; A63B 23/03533; A63B 23/12; A63B 24/0087

See application file for complete search history.

(56) References Cited

U.S. PATENT DOCUMENTS

| | | | | | |
|---|---|---|---|---|---|
| 4,846,460 | A * | 7/1989 | Duke | A63B 22/0076 | 482/73 |
| 4,884,800 | A * | 12/1989 | Duke | A63B 21/154 | 482/73 |
| 5,382,210 | A * | 1/1995 | Rekers | A63B 21/157 | 482/125 |
| 8,957,641 | B1 * | 2/2015 | Hsu | A63B 24/0087 | 322/4 |
| 9,061,171 | B2 * | 6/2015 | Hsieh | A63B 24/0087 | |
| 9,662,534 | B1 * | 5/2017 | Liu | A63B 21/0051 | |
| 10,376,735 | B2 * | 8/2019 | Bates | A63B 21/4035 | |
| 11,173,343 | B2 * | 11/2021 | Lee | A63B 24/0087 | |
| 11,179,590 | B1 * | 11/2021 | Nicholas | A63B 21/0051 | |
| 11,299,227 | B1 * | 4/2022 | Fang | B62J 9/20 | |
| 11,524,198 | B2 * | 12/2022 | Hsu | A63B 21/00072 | |

(Continued)

*Primary Examiner* — Garrett K Atkinson
(74) *Attorney, Agent, or Firm* — Rosenberg, Klein & Lee

(57) ABSTRACT

The fitness mechanism with adjustable resistance includes: a flywheel which is sleeved on the main shaft, it can adjust the rotational resistance of the flywheel by the magnitude of the eddy current; two rope reels are a one-way rotating member that operates in the opposite direction of each other, assembled on the main shaft of both sides of the flywheel, the outer end is connected with a volute spring, and the outer periphery is wound with a rope; Pulling the rope will make the rope reels drive the main shaft and the flywheel to rotate in the forward direction, and the rotational resistance of the flywheel will be fed back to the rope; stop pulling the rope, and the kinetic energy accumulated by the volute spring will cause the rope reels to rotate in the reverse direction to rewind the rope, so as to achieve a fitness similar to skiing or rowing.

4 Claims, 11 Drawing Sheets

(56) References Cited

U.S. PATENT DOCUMENTS

| | | | | |
|---|---|---|---|---|
| 2003/0022765 | A1* | 1/2003 | Wu | A63B 21/0051 482/92 |
| 2005/0277521 | A1* | 12/2005 | Lat | A63B 22/0076 482/72 |
| 2017/0043208 | A1* | 2/2017 | Lonergan | A63B 22/0087 |
| 2017/0047870 | A1* | 2/2017 | Lee | H02K 1/06 |
| 2018/0056118 | A1* | 3/2018 | Bates | A63B 22/0087 |
| 2018/0102695 | A1* | 4/2018 | Lee | H02K 7/104 |
| 2020/0147449 | A1* | 5/2020 | Liu | A63B 21/225 |
| 2021/0220703 | A1* | 7/2021 | Lee | A63B 21/153 |
| 2021/0244995 | A1* | 8/2021 | Andrei | A63B 21/0051 |
| 2021/0346747 | A1* | 11/2021 | Hsu | A63B 21/012 |

* cited by examiner

100

200

200

200

200

FITNESS MECHANISM WITH ADJUSTABLE RESISTANCE

BACKGROUND OF THE INVENTION

1. Field of the Invention

The present invention relates to a fitness mechanism, especially to one that adjust resistance by a magnetic flywheel, and has a rope reel equipped with a one-way bearing and a volute spring, and thereby achieve a fitness mechanism with adjustable resistance which having fitness effect similar to skiing or rowing.

2. Description of the Related Art

There are millions of people around the world love skiing and boating, most of them purely for fun, but many as sports competitions; but regardless of the mindset, they can gain fitness benefit through the process of activity. Second, skiing and boating are often influenced by seasons, weather, and fields, making it difficult for athletes to have activities continuously; therefore, in recent years, many inventors have created sports equipment for skiing and boating to satisfy indoors sports hobbies, the user can also perform fitness activities with the same function.

As showing in FIG. 1A, a conventional ski fitness machine uses left and right pull ropes 910/920 to pull a fan mechanism 940 through a frame 930, and the resistance comes from blades (not shown in the drawing) in the fan mechanism 940; although the resistance of pulling the rope is similar to the output of both hands during skiing, the resistance cannot be set and adjusted according to needs, so it cannot meet the requirement of users.

As showing in FIG. 1B, a conventional rowing machine uses a pulley 810 to pull a flywheel mechanism 820, and the motion resistance comes from the blades 830 on both sides of the flywheel mechanism 820 and the magnetic resistance mechanism 840 connected by its shaft; Although the resistance can be changed by changing the input current of the magnetic resistance mechanism 840, the rope is easily to slip when the pulley 810 has high resistance, and the movement resistance cannot be effectively fed back to the user; and the movement mode of the mechanism is to pull a handle 850 with both hands to drive the rope 860 to move, therefore cannot achieve the movement of alternating hands.

Reviewing the above-mentioned skiing and rowing fitness equipment, both are a kind of fitness equipment for strengthening arm muscles, so how to make both hands can simultaneously or alternately output, and the exercise resistance can be set and adjusted by the user, and effective feedback to the user are subjects to be further improved by the present inventors.

SUMMARY OF THE INVENTION

It is a primary objective of the present invention to provide a fitness mechanism that can adjust the resistance of the pulling force by adjusting the movement resistance by the magnetic flywheel, thereby strengthening the arm muscles.

Another objective of the present invention is to use a rope reel in conjunction with a one-way bearing to maintain inertia rotation, and to pull the rope back and forth in conjunction with a volute spring to achieve a fitness effect similar to skiing or rowing.

In order to achieve the above objectives, the fitness mechanism with adjustable resistance includes: a bracket group, a main shaft, a magnetic flywheel, two rope reels, two linkages, two volute springs and two protective caps; wherein, the bracket group having a left frame and a right frame, individually provided with a shaft hole and a fixing base, and the left frame and the right frame are combined into a whole by a plurality of spacer shafts and bolts; the main shaft, pivoted to the shaft hole of the bracket group by a bearing housing and a bearing; the magnetic flywheel, having a flywheel and at least a magnetic resistance mechanism, the flywheel has a center hole to sleeve on the main shaft, and make the flywheel rotate under the drive of the main shaft; the magnetic resistance mechanism having an electromagnet, a coil and an input wire, the magnetic resistance mechanism is fixed on a side of the bracket group through a positioning frame, having a gap for spacing and arranged on the outer periphery of the flywheel, after the input line being inputted with a DC current, an eddy current is formed, and a resistance effect will be generated against the rotating flywheel.

Also, the two rope reels are a one-way rotating member that operates in the opposite direction of each other, assembled on the main shaft of the left and right sides of the bracket group through a one-way rotating member that operates in the opposite direction of each other, having a ring groove on the outer periphery and a rope for winding on the ring groove, and pulling a free end of the rope individually will cause the rope reels to rotate; two linkages individually having a rod body and a plate body connected to each other, the plate body is assembled at an outer end of the rope reels, so that the linkages can rotate synchronously with the rope reels; the two volute springs individually sleeved on the rod body of the linkages, and an inner ring end of which is fixed on an outer edge of the rod body; the two protective caps are respectively assembled on the bracket group through a linking seat and sleeved on an outer edge of the volute springs, and the outer ring end of the volute springs are clamped in an embedding slot of an inner edge of the protective caps.

Whereby changing the input current of the magnetic resistance mechanism, and the eddy current formed by the input current will change the rotational resistance of the flywheel accordingly; once the free end of the rope is pulled, the rope reel will drive the main shaft and the flywheel to rotate in the forward direction, then the rotational resistance of the flywheel will be fed back to the pulling of the rope, thereby achieving the fitness effect of adjusting the strength; due to the connection of the linkages, the rope reels will also drive the inner ring end of the volute springs to rotate, and when the pulling of the rope is stopped, the kinetic energy stored by the volute springs will cause it to rewind, and at the same time drive the rope reels to rotate in the opposite direction to rewind the rope, the main shaft and the flywheel will continuously maintain inertial rotation due to the action of the one-way rotating member.

Also, the one-way rotating member includes a one-way bearing.

Also, the present invention includes a fitness frame, which has a frame base that can stand on the ground and two frame supports symmetrically arranged on the top surface of the frame base, the turning points of the frame supports are individually provided with a guide pulley; the fixing base of the bracket group is locked on the frame base, then the free end of the rope is set through the inner edge of the frame supports and winding the guide pulley, and the tail end is connected with a grip, so the user can pull the rope back and forth by holding the grip with both hands to do fitness action.

Also, the present invention includes a control unit, which is installed on the fitness frame, having a human-machine interface and a rectifying member, and is connected with an external power source and the input wire of the magnetic resistance mechanism, so the user can input desired resistance value through the human-machine interface to accordingly adjust the strength of the pulling force.

With the features disclosed above, the present invention has below effects:

1. The magnetic flywheel in the present invention has a flywheel and at least one magnetic resistance mechanism; the flywheel is sleeved on the main shaft to receive the driving of the main shaft and rotates; the magnetic resistance mechanism includes an electromagnet, a coil and an input wire, the magnetic resistance mechanism is fixed on a side of the bracket group through a positioning frame, having a gap for spacing and arranged on the outer periphery of the flywheel, after the input line being inputted with a DC current, an eddy current is formed, and a resistance effect will be generated against the rotating flywheel, so as to adjust the resistance of the flywheel to achieve the fitness effect of strengthening the arm muscle.

2. The two rope reels in the present invention are formed by one-way bearing that operates in the opposite direction of each other, assembled on the main shaft of the left and right sides of the bracket group, and pulling a free end of the rope individually will cause the rope reels to rotate, and the resistance of the flywheel will be fed back to the rope; the rope reels are also connected with a volute spring to make it roll, when the rope stops being pulled, the volute spring will force the rope reels to rotate in the opposite direction to rewind the rope, so the user can use both hands at the same time or alternately to pull the rope back and forth to achieve the fitness effect of strengthening both arms.

3. The fixing base of the bracket group in the present invention is used to lock the fitness mechanism on the frame base of the fitness frame, two frame supports are symmetrically arranged on the top surface of the frame base, the turning points of the frame supports are individually provided with a guide pulley; the free end of the rope is set through the inner edge of the frame supports and winding the guide pulley, and the tail end is connected with a grip, so the user can pull the rope back and forth by holding the grip with both hands to do fitness action like skiing and rowing.

DETAILED DESCRIPTION OF THE PREFERRED EMBODIMENT

Figure 1A:
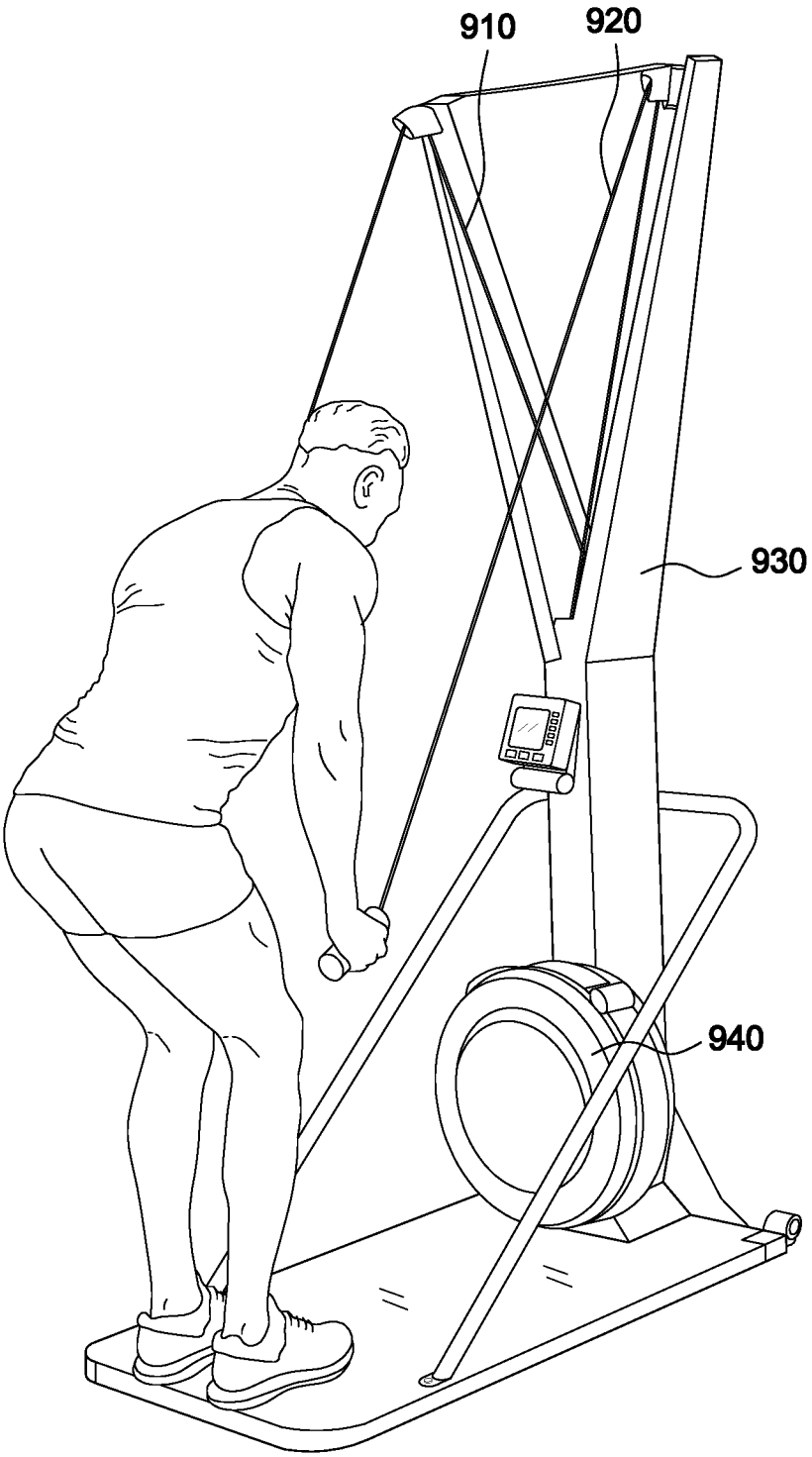
FIG.1A PRIOR ART
FIG. 1A is a schematic diagram of the conventional skiing machine.
Figure 1B:
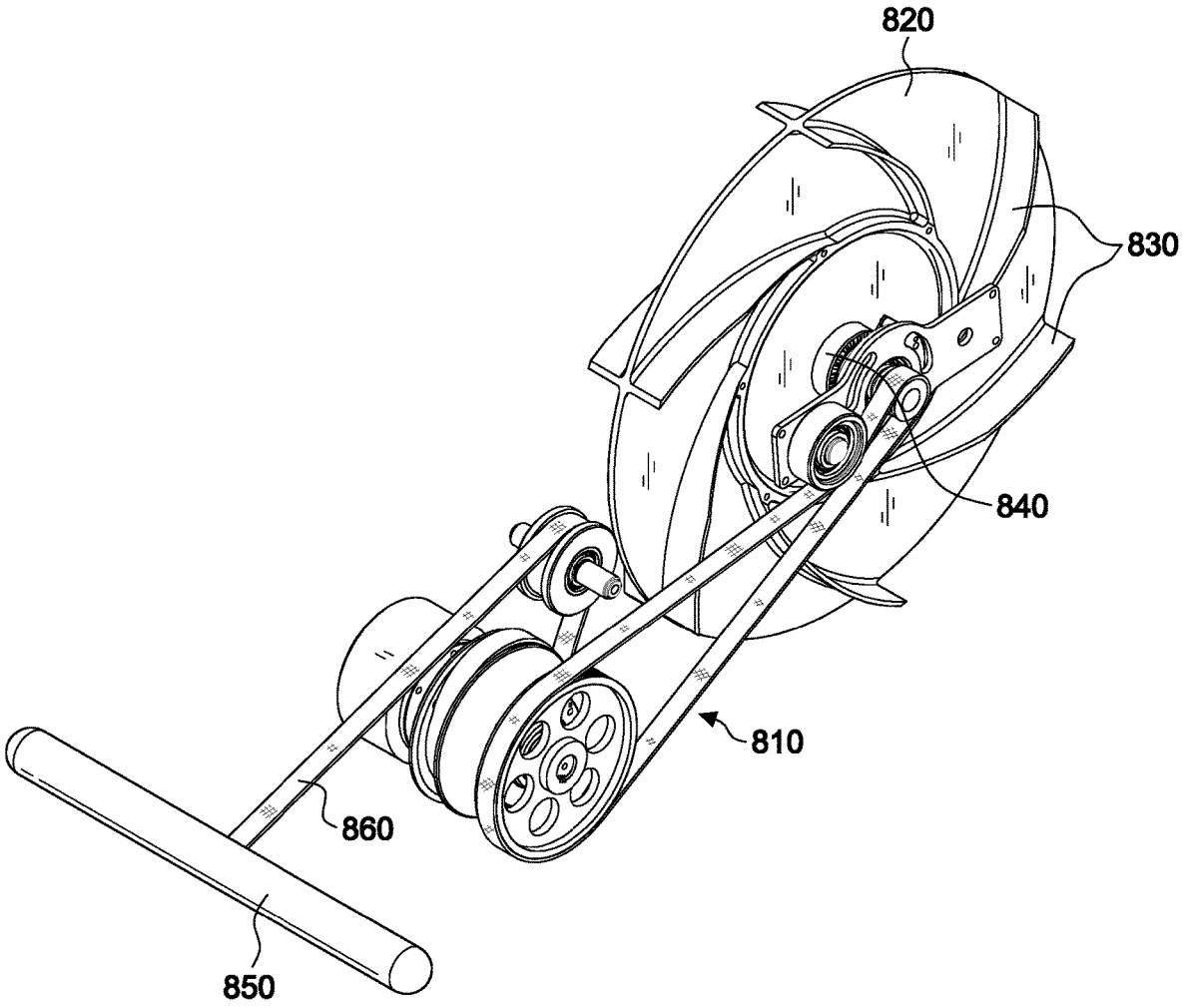
FIG.1B PRIOR ART
FIG. 1B is a schematic diagram of the conventional rowing machine.
Figure 2:
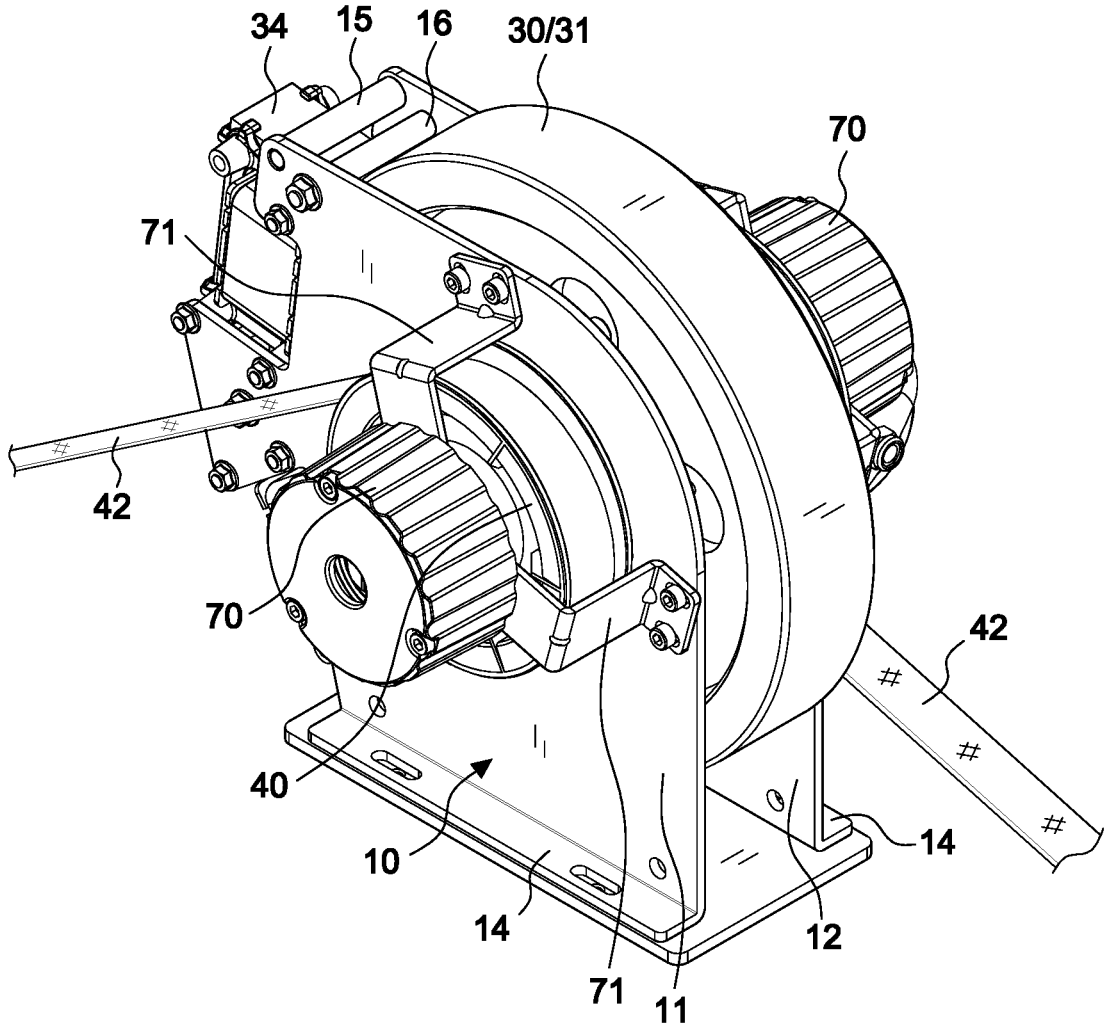
FIG. 2 is an assembly perspective views of the present invention.
Figure 3:
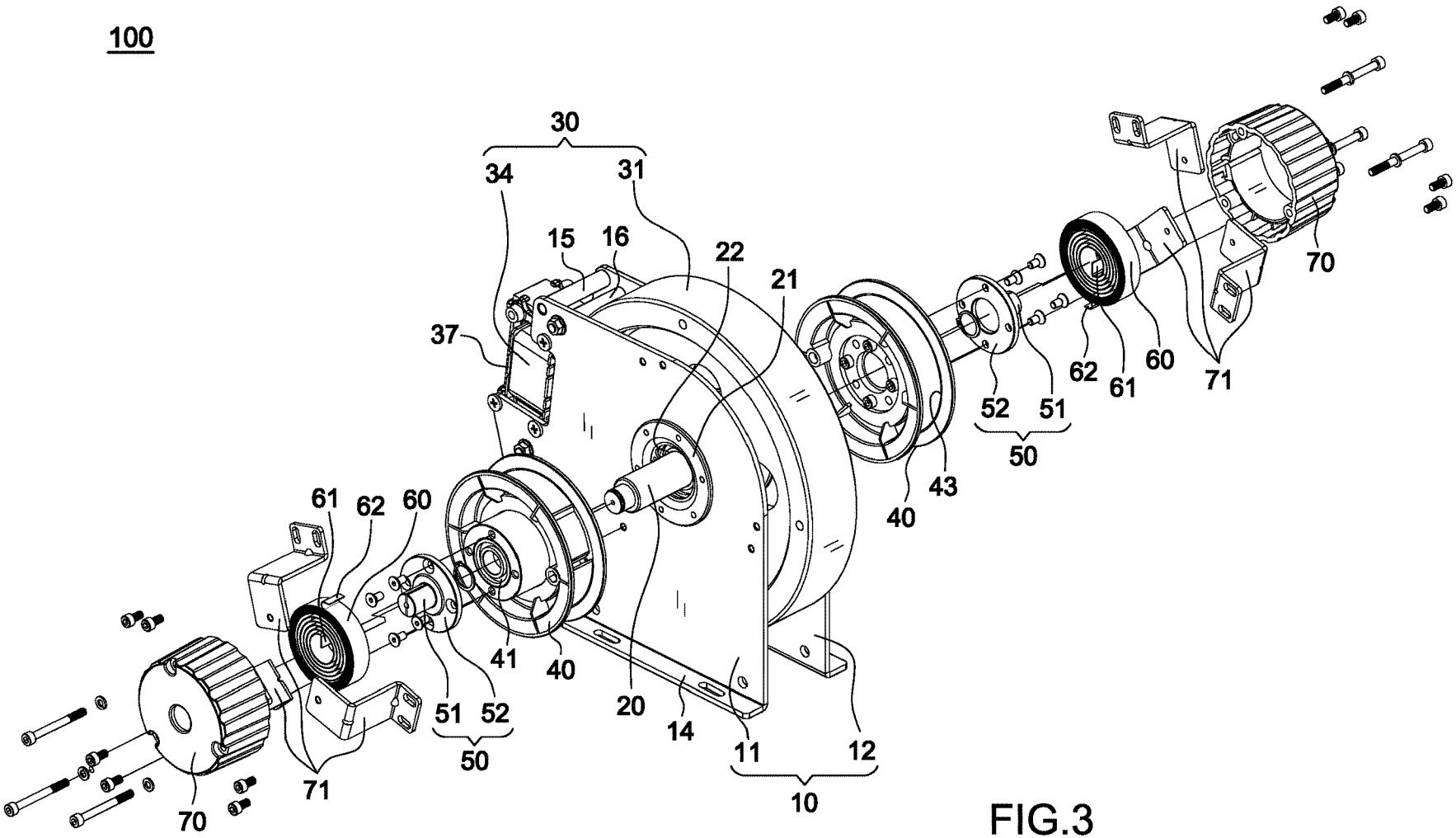
FIG. 3 is an exploded perspective views of the present invention.
Figure 4:
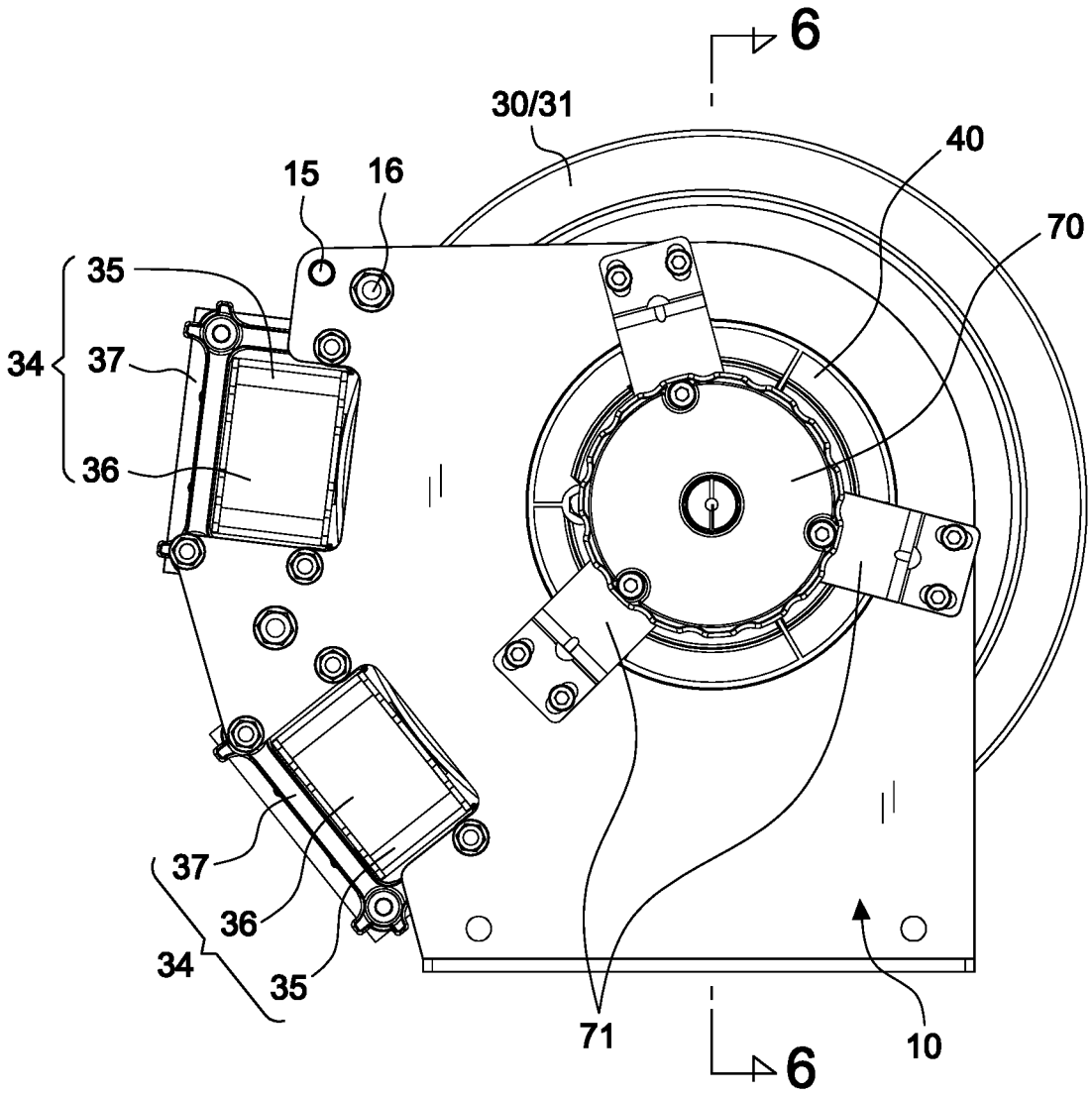
FIG. 4 is a side views of the present invention
Figure 5:
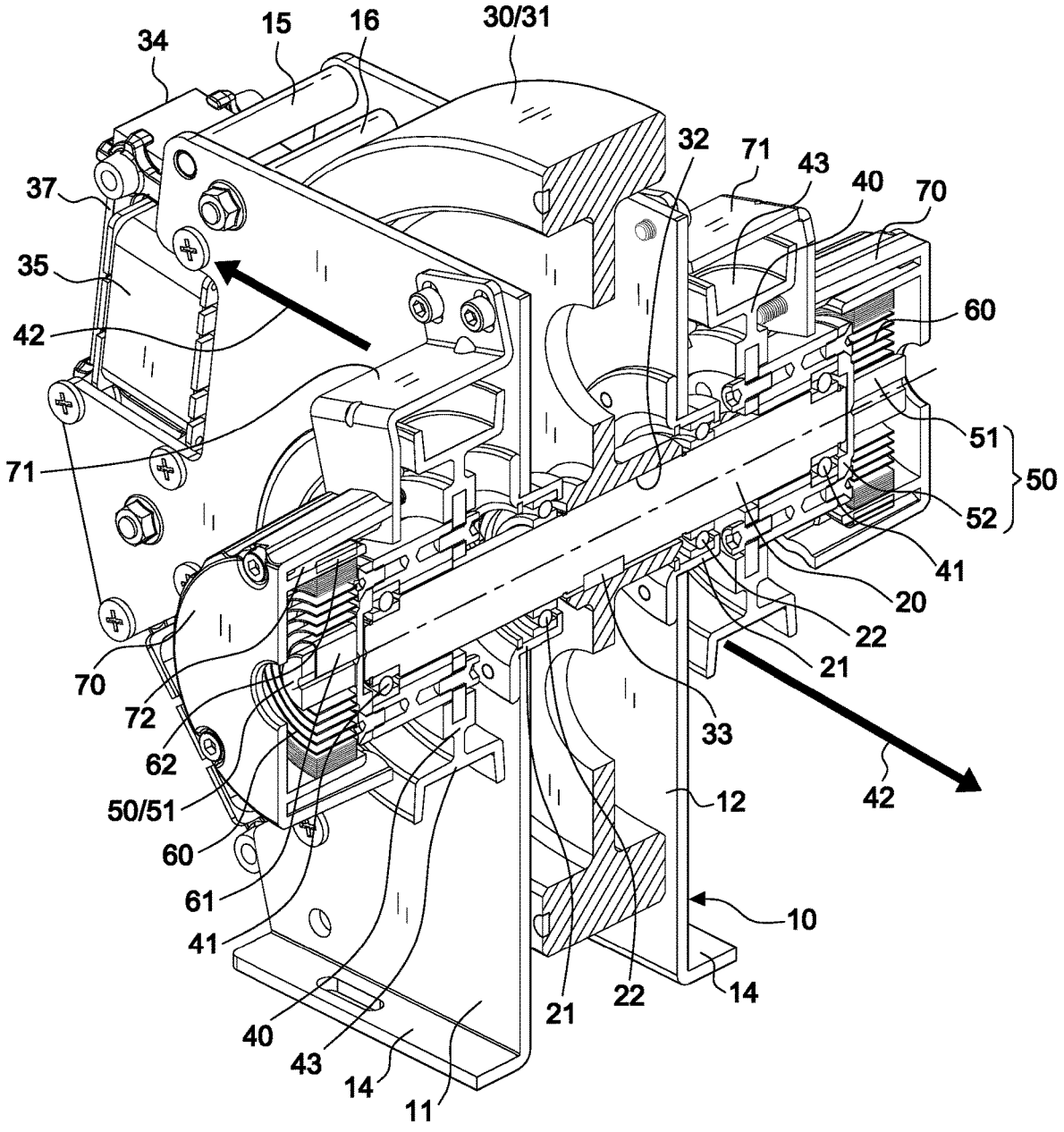
FIG. 5 is a sectional views of the present invention.
Figure 6:
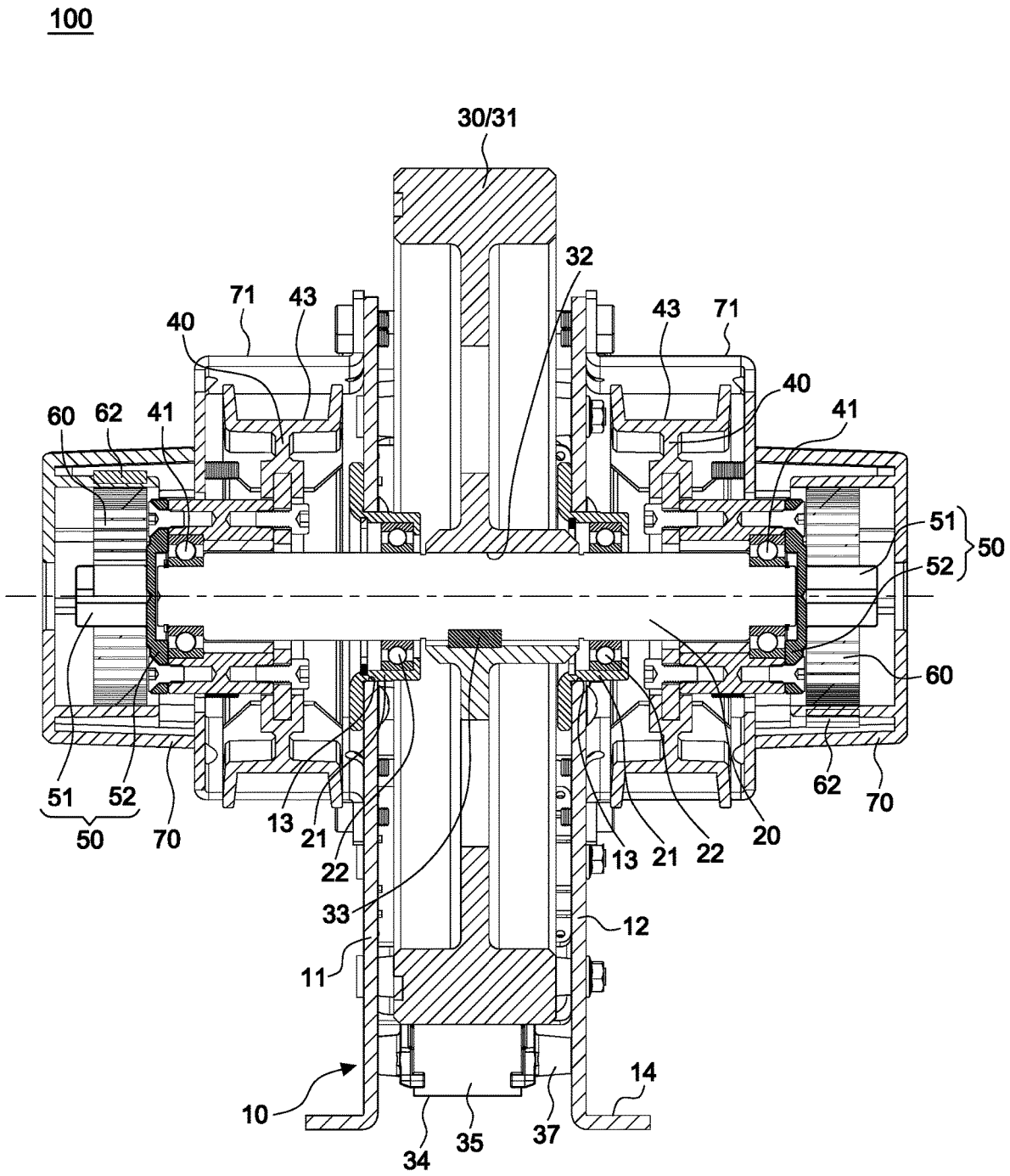
FIG. 6 is a front sectional views of the present invention.

Referring to FIGS. 2~6, the present invention, fitness mechanism with adjustable resistance 100 includes: a bracket group 10, a main shaft 20, a magnetic flywheel 30, two rope reels 40, two linkages 50, two volute springs 60 and two protective caps 70; wherein the bracket group 10 having a left frame 11 and a right frame 12, individually provided with a shaft hole 13 and a fixing base 14, and the left frame 11 and the right frame 12 are combined into a whole by a plurality of spacer shafts 15 and bolts 16; the main shaft 20, pivoted to the shaft hole 13 of the bracket group 10 by two set of bearing housings 21 and two bearings 22, making the main shaft 20 rotate in the bracket group 10; the magnetic flywheel 30, having a flywheel 31 and at least a magnetic resistance mechanism 34, the flywheel 31 has a center hole 32 to sleeve on the main shaft 20 by a square key 33, and make the flywheel 31 rotate under the drive of the main shaft 20; the magnetic resistance mechanism 34 having an electromagnet 35 with E-shaped body, a coil 36 arranged at the inner concave part of the E-shaped body and an input wire which connected with the coil 36, the magnetic resistance mechanism 34 is fixed on a side of the bracket group 10 through a positioning frame 37, having a gap for spacing and arranged on the outer periphery of the flywheel 31, after the input line being inputted with a DC current to the coil 36, an eddy current is formed, and a resistance effect will be generated against the rotating flywheel 31; in this embodiment, the magnetic resistance mechanism 34 is provided with two groups, and they are respectively arranged on one side of the bracket group 10 with an angle, which can disperse the resistance effect and make the rotation rate of the flywheel 31 more stable.

Two rope reels 40 are a one-way rotating member that operates in the opposite direction of each other, in this embodiment, the one-way rotating member is a one-way bearing 41, assembled on the main shaft 20 of the left and right sides of the bracket group 10, because the function of the one-way bearing 41 is to make the driven member (the main shaft 20) only rotate in one direction, and the one-way bearings 41 arranged on the left and right sides of the bracket group 10 have opposite directions of action, so if the one-way bearing 41 of the left side of the bracket group 10 rotate forward, then the rope reel 40 on the left side of the bracket group 10 will drive the main shaft 20 to rotate forward, and when the rope reel 40 is rotated in the reverse direction, it will form an idling relative to the main shaft 20 (the main shaft 20 continues to rotate forward); in the contrary, the backward rotation of the rope reel 40 of the right side of the bracket group 10 will drive the main shaft 20 to rotate forward, when the rope reel 40 is rotated in the reverse direction, it will form an idling relative to the main shaft 20 (the main shaft 20 continues to rotate forward); also, the rope reel 40 having a ring groove 43 on the outer periphery and a rope 42 for winding on the ring groove 43, and pulling a free end of the rope 42 individually will cause the rope reels 40 to drive the main shaft 20 to rotate; two linkages 50 individually having a rod body 51 and a plate body 52 connected to each other, the plate body 52 is assembled at an outer end of the rope reels 40, so that the linkages 50 can rotate synchronously with the rope reels 40; two volute springs 60 individually sleeved on the rod body 51 of the linkages 50, and an inner ring end of which is fixed on an outer edge of the rod body 51; two protective caps 70 are respectively assembled on the bracket group 10 through a linking seat 71 and sleeved on an outer edge of the volute springs 60, in this embodiment, each set of protective caps 70 uses three pieces of linking seat 71 in the shape of Z, and the outer ring end of the volute springs 60 is clamped in an embedding slot 72 of an inner edge of the protective caps 70; and since the inner ring end 61 of the volute spring 60 is fixed on the rod body 51 of the linkages 50 that rotates synchronously with the rope reels 40, and the outer ring end 62 is clamped on the fixed protective caps 70, therefore, when the rope 42 is pulled to rotate the rope reels 40, the volute spring 60 will be rolled up to store kinetic energy.

Whereby changing the input current of the magnetic resistance mechanism 34, and the eddy current formed by the electromagnet 35 will change the rotational resistance of the flywheel 31 accordingly; once the free end of the rope 42 is pulled, the rope reel 40 will drive the main shaft 20 and the flywheel 31 to rotate in the forward direction, then the rotational resistance of the flywheel 31 will be fed back to the pulling of the rope 42, thereby achieving the fitness effect of adjusting the strength; moreover, due to the connection of the linkages 50, the rope reels 40 will also drive the inner ring end 61 of the volute springs 60 to rotate, and when the pulling of the rope 42 is stopped, the kinetic energy stored by the volute springs 60 will cause it to rewind, and at the same time drive the rope reels 40 to rotate in the opposite direction to rewind the rope 42, the main shaft 20 and the flywheel 31 will continuously maintain inertial rotation due to the action of the one-way rotating member.

Figure 7:
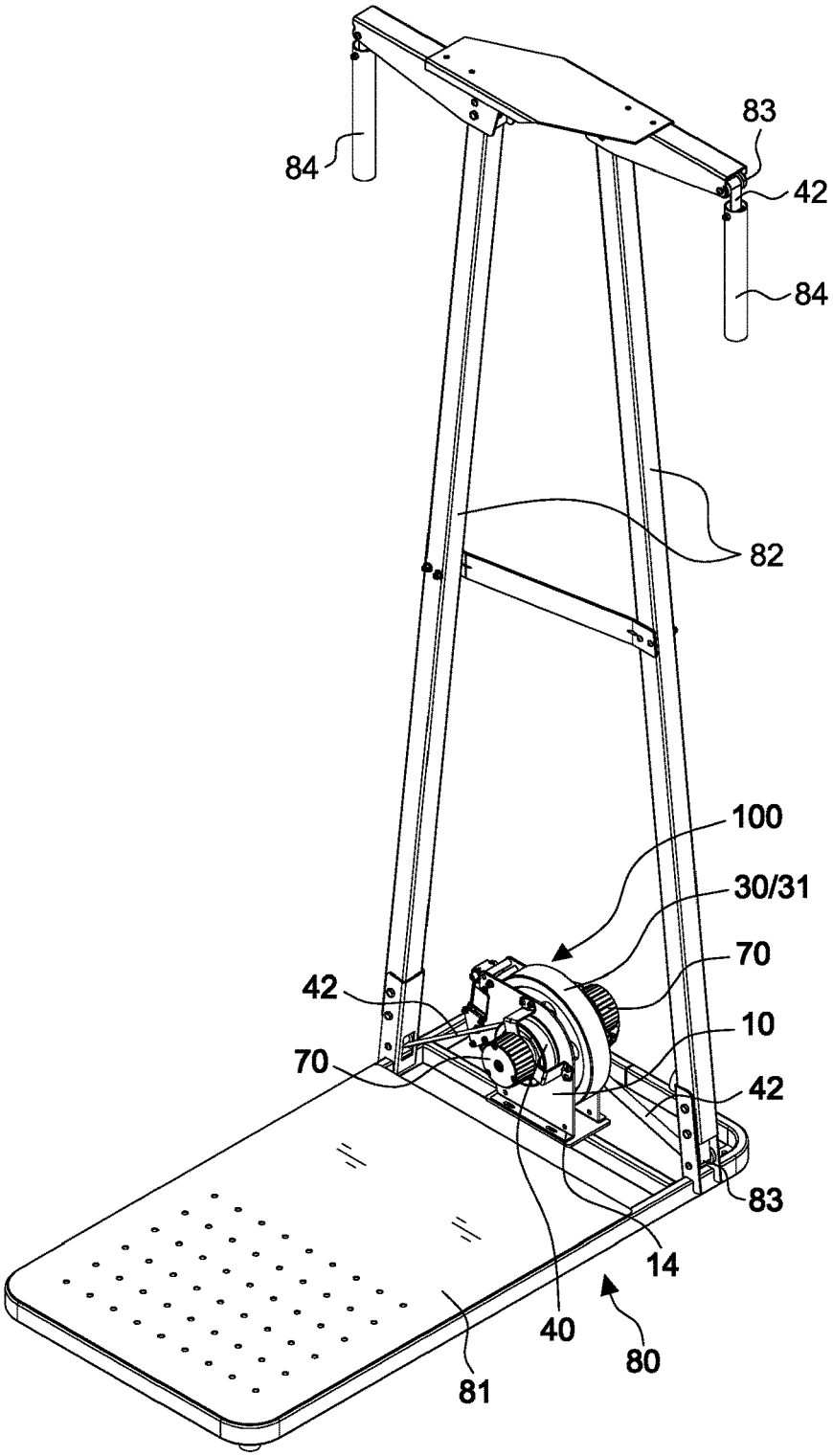
FIG. 7 is an assembly perspective views of the skiing machine of the present invention.
Figure 8:
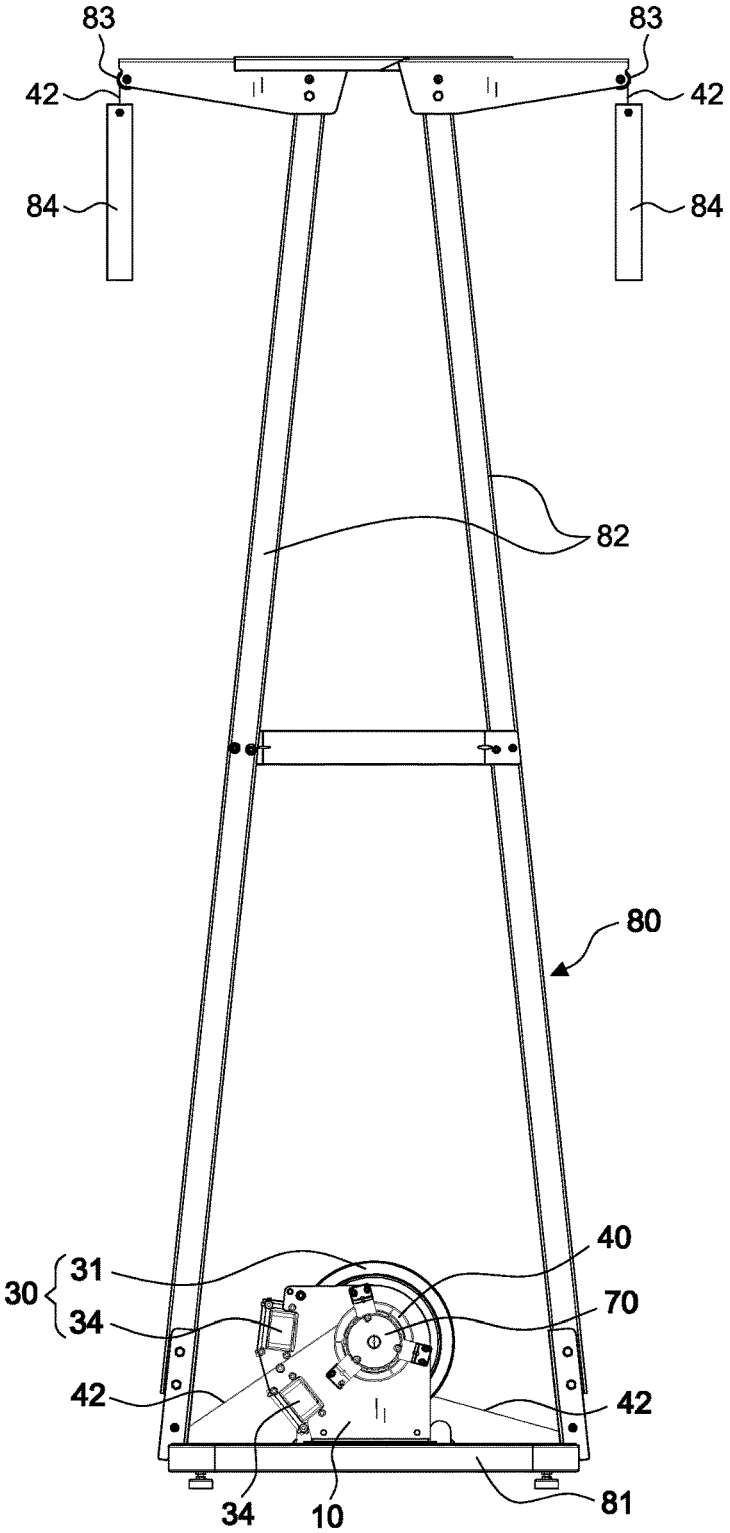
FIG. 8 is a front views of the skiing machine of the present invention.
Figure 9:
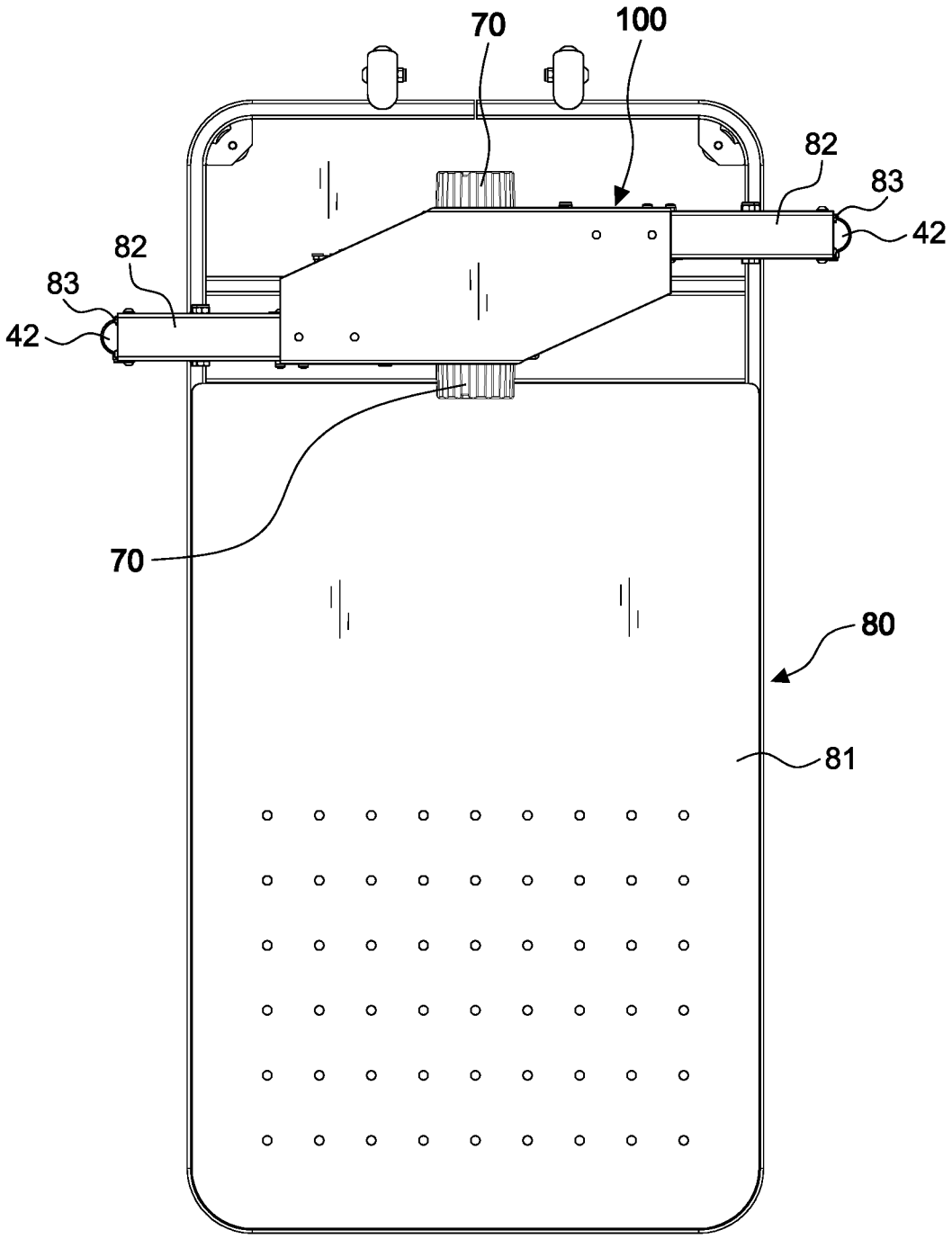
FIG. 9 is a top views of the skiing machine of the present invention.

Referring to FIGS. 7~9, the present invention, fitness mechanism with adjustable resistance 100 applies to the ski fitness equipment 200: the ski fitness equipment 200 includes a fitness frame 80, which has a frame base 81 that can stand on the ground and two frame supports 82 symmetrically arranged on the top surface of the frame base 81, the turning points of the frame supports 82 are individually provided with a guide pulley 83; the fixing base 14 of the bracket group 10 is locked on the frame base 81, then the free end of the rope 42 is set through the inner edge of the frame supports 82 and winding the guide pulley 83, and the tail end is connected with a grip 84, when the user pulls the rope 42 back and forth with both hands by holding the grip 84, the rope reels 40 will drive the main shaft 20 and the flywheel 30 to rotate forward, and the resistance of the flywheel 31 will be fed back to the pulling of the rope 42 to achieve a fitness effect; when the pulling of the rope 42 is stopped, the kinetic energy of the volute spring 60 will cause the rope reel 40 to rotate in the opposite direction to rewind the rope 42, while the main shaft 20 and the flywheel 31 continue to rotate by inertia.

Wherein includes a control unit, which is installed on the fitness frame 80, having a human-machine interface and a rectifying member, and is connected with an external power source and the input wire of the magnetic resistance mechanism 34, so the user can input desired resistance value through the human-machine interface to accordingly adjust the strength of the pulling force, then the control unit will adjust the input current value through the rectifying member, and after the input wire transmits the current into the coil 36, the electromagnet 35 will generate an eddy current, and produce a resistance to the rotating flywheel 31; since the human-machine interface is convenient for the user to input the desired resistance value, the control unit changes the current value immediately, and the rotational resistance of the flywheel 31 is directly fed back to the pulling of the rope 42, so the ski fitness equipment 200 of the present invention will have adjustable resistant effect.

Figure 10:
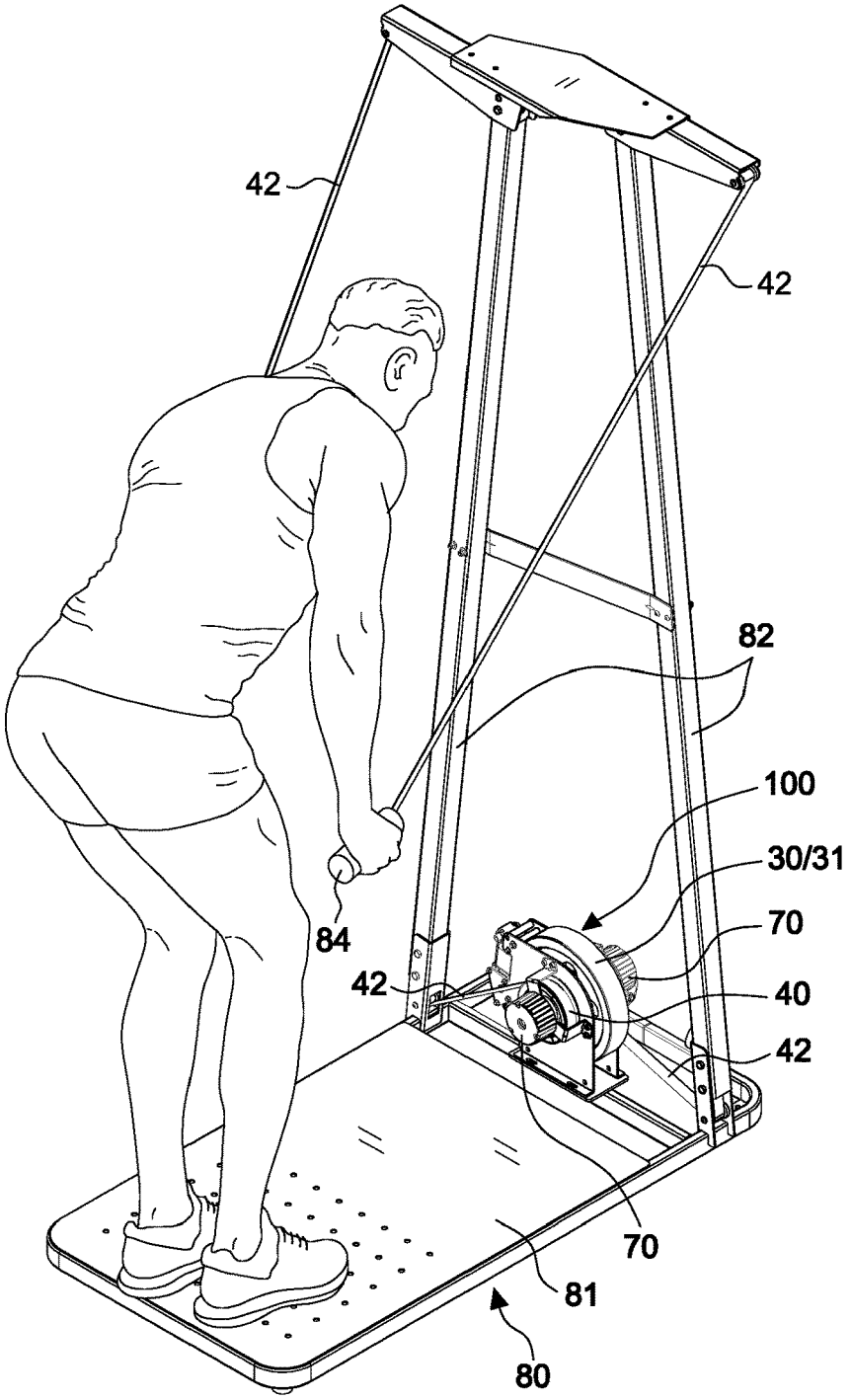
FIG. 10 is a schematic diagram of illustrating the operating demonstration of the skiing machine of the present invention.

Referring to FIG. 10, the operation of the ski fitness equipment 200 of the present invention, in the figure, the user's feet are standing on the frame base 81 of the fitness frame 80, and his hands are holding the grip 84, the user can pull the rope 42 simultaneously or alternately with both hands, then the rope reel 40 will drive the main shaft 20 and the flywheel 31 to rotate forward, and then both hands stop pulling the rope 42 at the same time or alternately, then the rope reel 40 rotates in the opposite direction to rewind the rope 42, and the main shaft 20 and the flywheel 31 continue to rotate by inertia; since the rotational resistance of the flywheel 31 will be fed back to the pulling of the rope 42, the ski fitness equipment 200 will achieve a fitness effect similar to outdoor skiing. The two frame supports 82 of the fitness frame 80 of the ski fitness equipment 200 of the present invention are vertically erected on the top surface of the frame base 81. Lying or sitting on the frame base 81 and pulling the rope 42 back and forth with both hands simultaneously or alternately, the structure of the rowing exercise machine 200 is formed.

The magnetic flywheel 30 in the present invention has a flywheel 31 and at least one magnetic resistance mechanism 34; the flywheel 31 is sleeved on the main shaft 20 to receive the driving of the main shaft 20 and rotates; the magnetic resistance mechanism 34 includes an electromagnet 35, a coil 36 and an input wire, which are fixed on the outer periphery of the flywheel 31 through a positioning frame 37 at a distance of a gap. When the input wire is inputted with a direct current, the electromagnet 35 will generate an eddy current and a resistance effect will be generated on the rotating flywheel 31, and the magnitude of the eddy current can be changed by changing the current of the direct current, and then the rotating resistance of the flywheel 31 can be adjusted to achieve the fitness effect of strengthening the arm muscles. Secondly, the present invention uses two rope reels 40, which are individually combined with one-way bearings 41 in opposite directions of action, and are arranged on the main shafts 20 on both sides of the bracket group 10, then pulling the rope 42 on the periphery of the rope reel 40 will drive the main shaft 20 and the flywheel 31 inertially rotated forward, and the rotational resistance of the flywheel 31 will be fed back to the rope 42; the rope reel 40 is also connected with a volute spring 60 to make it roll, then when the pulling of the rope 42 is stopped, the volute spring 60 will urge the rope reel 40 to rotate in the opposite direction to rewind the rope 42, so the user can pull the rope 42 back and forth with both hands simultaneously or alternately, so as to achieve the fitness effect of strengthening both arms. Furthermore, in the present invention, the fixing base 14 of the bracket group 10 is used to lock the fitness mechanism on the frame base 81 of the fitness frame 80, and two frame supports 82 in a symmetrical configuration are arranged on the top surface thereof, and at the turning point of the frame supports 82 has a guide pulley 83; after the free end of the rope 42 is set through the inner edge of the frame supports 82 and winding the guide pulley 83, and the tail end is connected with a grip 84, so the user can pull the rope 42 back and forth by holding the grip 84 with both hands to do fitness action similar to skiing and rowing.

What is claimed is:

1. A fitness mechanism with adjustable resistance, comprising:

a bracket group, having a left frame and a right frame, individually provided with a shaft hole and a fixing base, and the left frame and the right frame are combined into a whole by a plurality of spacer shafts and bolts;

a main shaft, pivoted to the shaft hole of the bracket group by a bearing housing and a bearing;

a magnetic flywheel, having a flywheel and at least a magnetic resistance mechanism, the flywheel has a center hole to sleeve on the main shaft, and make the flywheel rotate under the drive of the main shaft;

the magnetic resistance mechanism having an electromagnet, a coil and an input wire, the magnetic resistance mechanism is fixed on a side of the bracket group through a positioning frame, having a gap for spacing and arranged on the outer periphery of the flywheel, after the input line being inputted with a DC current, an eddy current is formed, and a resistance effect will be generated against the rotating flywheel;

two rope reels are a one-way rotating member that operates in the opposite direction of each other, assembled on the main shaft of the left and right sides of the bracket group, having a ring groove on the outer periphery and a rope for winding on the ring groove, and pulling a free end of the rope individually will cause the rope reels to rotate;

two linkages individually having a rod body and a plate body connected to each other, the plate body is assembled at an outer end of the rope reels, so that the linkages can rotate synchronously with the rope reels;

two volute springs individually sleeved on the rod body of the linkages, and an inner ring end of which is fixed on an outer edge of the rod body;

two protective caps are respectively assembled on the bracket group through a linking seat and sleeved on an outer edge of the volute springs, and the outer ring end of the volute springs is clamped in an embedding slot of an inner edge of the protective caps; and changing the input current of the magnetic resistance mechanism, and the eddy current formed by the input current will change the rotational resistance of the flywheel accordingly; once the free end of the rope is pulled, the rope reel will drive the main shaft and the flywheel to rotate in the forward direction, then the rotational resistance of the flywheel will be fed back to the pulling of the rope, thereby achieving the fitness effect of adjusting the pulling strength; due to the connection of the linkages, the rope reels will also drive the inner ring end of the volute springs to rotate, and when the pulling of the rope is stopped, the kinetic energy stored by the volute springs will cause it to rewind, and at the same time drive the rope reels to rotate in the opposite direction to rewind the rope, the main shaft and the flywheel will continuously maintain inertial rotation due to the action of the one-way rotating member.

2. The fitness mechanism with adjustable resistance as claimed in claim 1, wherein the one-way rotating member includes a one-way bearing.

3. The fitness mechanism with adjustable resistance as claimed in claim 1, further including a fitness frame, which has a frame base that can stand on the ground and two frame supports symmetrically arranged on the top surface of the frame base, the turning points of the frame supports are individually provided with a guide pulley; the fixing base of the bracket group is locked on the frame base, then the free end of the rope is set through the inner edge of the frame supports and winding the guide pulley, and the tail end is connected with a grip, so the user can pull the rope back and forth by holding the grip with both hands to do a fitness action.

4. The fitness mechanism with adjustable resistance as claimed in claim 3, further including a control unit, which is installed on the fitness frame, having a human-machine interface and a rectifying member, and is connected with an external power source and the input wire of the magnetic resistance mechanism, so the user can input a desired resistance value through the human-machine interface to accordingly adjust the strength of the pulling force.

* * * * *